US006092541A

United States Patent [19]

Crane et al.

[11] Patent Number: 6,092,541

[45] Date of Patent: Jul. 25, 2000

[54] COMPACT KITCHENWARE WASHING STATION

[75] Inventors: David R. Crane, Marengo, Ill.; William M. Swift, Sr., Ft. Wayne, Ind.

[73] Assignee: S. C. Johnson Commercial Markets, Inc., Sturtevant, Wis.

[21] Appl. No.: 09/120,401

[22] Filed: Jul. 22, 1998

[51] Int. Cl.[7] ..... B08B 3/04

[52] U.S. Cl. ..... 134/88; 134/91; 134/92

[58] Field of Search ..... 134/88, 91, 84, 134/85, 92

[56] References Cited

U.S. PATENT DOCUMENTS

| | | | |
|---|---|---|---|
| 726,016 | 4/1903 | Blanchard | 134/91 |
| 2,213,359 | 9/1940 | Bessett | 134/91 |
| 2,573,965 | 11/1951 | Guglielmoni | 134/88 |
| 5,398,708 | 3/1995 | Sheldon | 134/91 |
| 5,501,240 | 3/1996 | Dohku et al. | 134/88 |
| 5,535,766 | 7/1996 | Edwards | 134/88 |

FOREIGN PATENT DOCUMENTS

| | | | |
|---|---|---|---|
| 358762 | 10/1931 | United Kingdom | 134/88 |

OTHER PUBLICATIONS

The last page of a 1997 CMA catalog showing a dishwashing station.

*Primary Examiner*—Frankie L. Stinson
*Attorney, Agent, or Firm*—Neil E. Hamilton; Warren R. Bovee

[57] ABSTRACT

A compact kitchenware washing station providing a variety of functions wherein three sink members are adjacently positioned and aligned adjacent to an automatic dishwashing apparatus. For an automatic operation, two of the sinks can be covered to support dishwashing racks with dishes. When a manual operation is desired, the covers are removed and the sink members utilized to provide a wash, rinse, and sanitizing operation. The kitchenware washing station is compact in design so that it can be utilized in even the smallest type of food service operation.

8 Claims, 6 Drawing Sheets

COMPACT KITCHENWARE WASHING STATION

CROSS REFERENCES TO RELATED APPLICATIONS

None

STATEMENT REGARDING FEDERALLY SPONSORED RESEARCH OR DEVELOPMENT

None

BACKGROUND OF THE INVENTION

1. Technical Field

This invention relates to dishwashing apparatus and more particularly, one that is of compact design and can accommodate a variety of dishwashing functions.

2. Background Art

Cleaning and sanitizing of dishes and utensils are either processed manually using a multi-compartment sink where dishes etc. are washed, rinsed, sanitized and then air dried before reuse or use a mechanical washer that automatically washes and sanitizes the ware before use. Both processes require labor that is typically unskilled and paid at the minimum wage.

The manual process requires that the employees are trained in the proper procedures of washing, rinsing and sanitizing to assure safe sanitized ware. The mechanical process also uses the same type of labor as the manual washing but is not as dependent on critical defined procedures. The mechanical washer automatically washes, rinses, and sanitizes the ware. It also automatically dispenses the proper amount of chemical agents reducing the health risk.

All foodservice faces the issue of high employee turnover, poor supervision, low skilled workers and increasing chances for food related sanitation problems. In addition, most kitchens are very limited in space; especially in the washing areas.

There is available a dishwashing station which includes a one-compartmnent sink for pre-rinsing dishes, an automatic dishwasher, and a drying table. This is available from CMA Dish Machines in Garden Grove, Calif. While this device is very adequate for use in conjunction with a dishwashing apparatus, it would be desirable to have an apparatus that could serve both functions of a hand, or manual, dishwashing process as well as an automatic one.

The objects of the invention, therefore are:

a. Providing a kitchenware washing station for use where space is limited.

b. Providing a station of the foregoing type which has a safe and a cost-effective means of washing kitchenware.

c. Providing a station of the foregoing type which can accommodate both manual and automatic washing.

d. Providing a washing station of the above kind which is readily adaptable to being connected to utilities in an efficient manner.

The term "kitchenware" as used herein is meant to include dishes, pots/pans, trays, knives, forks, spoons, and all other utensils normally associated with the preparation, serving, and eating of food.

BRIEF SUMMARY OF THE INVENTION

The foregoing objects are accomplished and the shortcomings of the prior art are overcome by the compact kitchenware washing station of this invention which is capable of providing a variety of functions and in one embodiment which includes first, second, and third sink members adjacently positioned and aligned with each other. A cover member is constructed and arranged to be placed over the first and second sink members. There is at least one faucet member operatively associated with the first and second sink members. A spray valve member is operatively associated with the third sink member. An automatic kitchenware washing apparatus is positioned adjacent to the third sink member; and a table member is positioned adjacent to the automatic kitchenware washing apparatus opposite the third sink member.

In another embodiment the station includes at least one support member for the cover member operatively associated with the first or second sink members.

In yet another embodiment, the kitchenware washing station includes a scrap basket member positioned in the third sink member.

In still another embodiment, the kitchenware washing station includes a storage compartment positioned below the table member.

In yet still another embodiment, the kitchenware washing station includes a storage compartment positioned below the kitchenware washing apparatus.

In one aspect, a five stage compact kitchenware washing station is provided which includes the first, second, and third sink members, the automatic kitchenware washing apparatus and the table member.

DETAILED DESCRIPTION OF THE INVENTION

Figure 3:
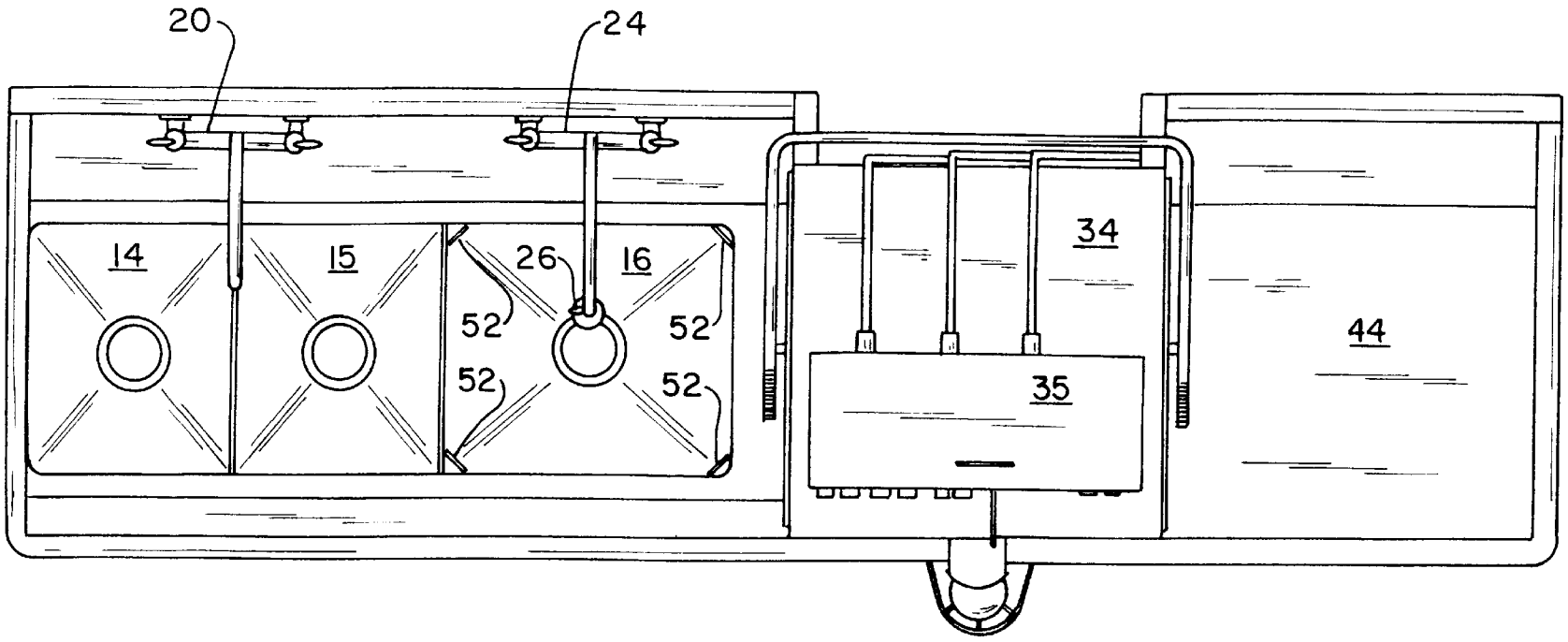
FIG. 3 is a top plan view thereof.

Referring to FIGS. 1–3, 6 and 7, the compact kitchenware washing station is shown generally at 10. It includes a one-piece frame 12 supporting a first sink member 14, a second sink member 16, and a third sink member 18. There is the usual faucet 20 with a swivel nozzle 22 so as to direct water into either the first sink member 14 or the second sink member 16. A pre-rinse device 24 having a spray valve nozzle 26 is placed over the third sink member 18. As seen in FIG. 3, beneath each sink member 14, 15, & 16 are drain valves 28 each having a control knob 30 so as to be able to close the valves and retain water in each of the sink members. The drain valves 28 are connected to the usual common drain pipe 32.

Figure 5:
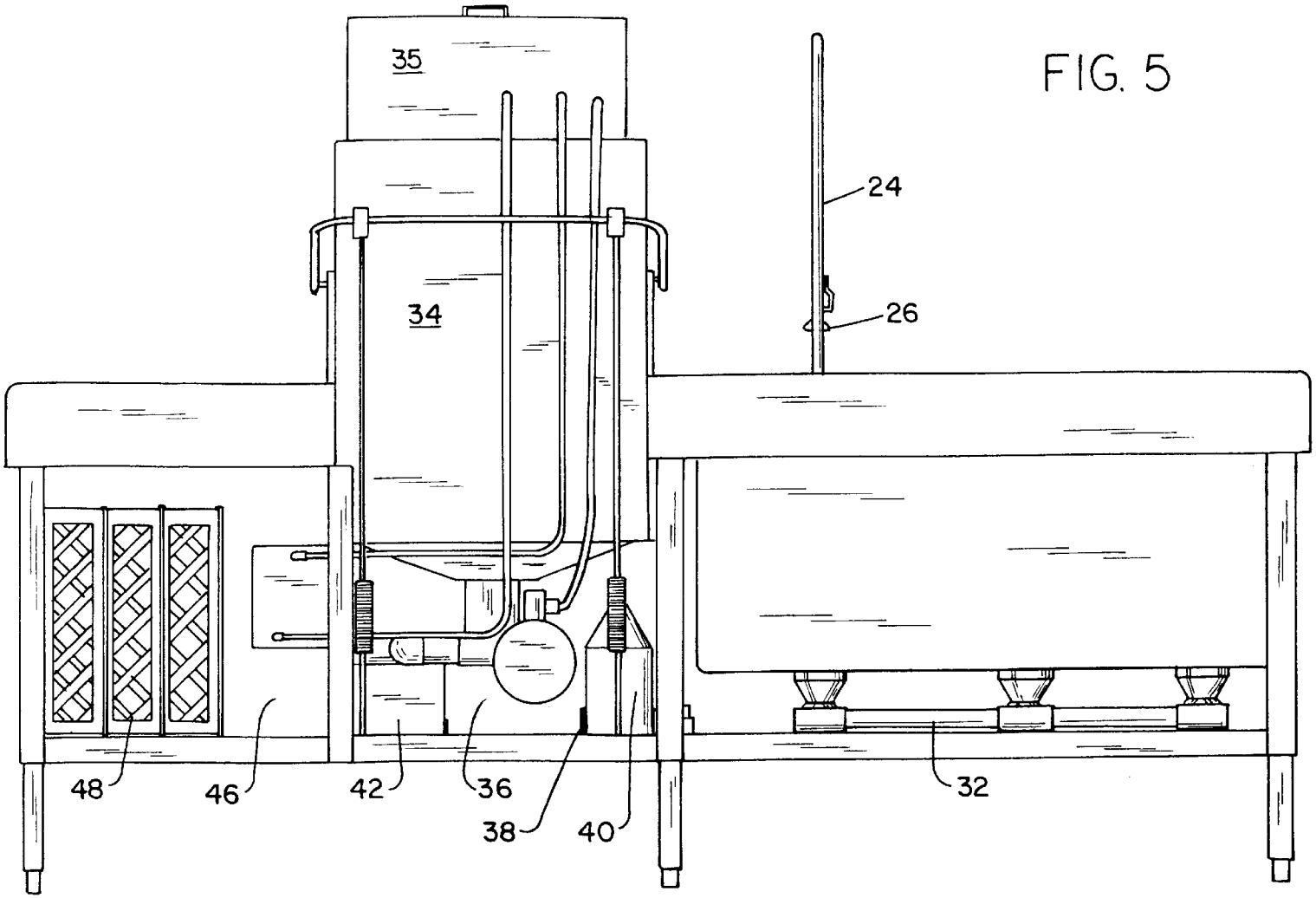
FIG. 5 is a rear view thereof.
Figure 7:
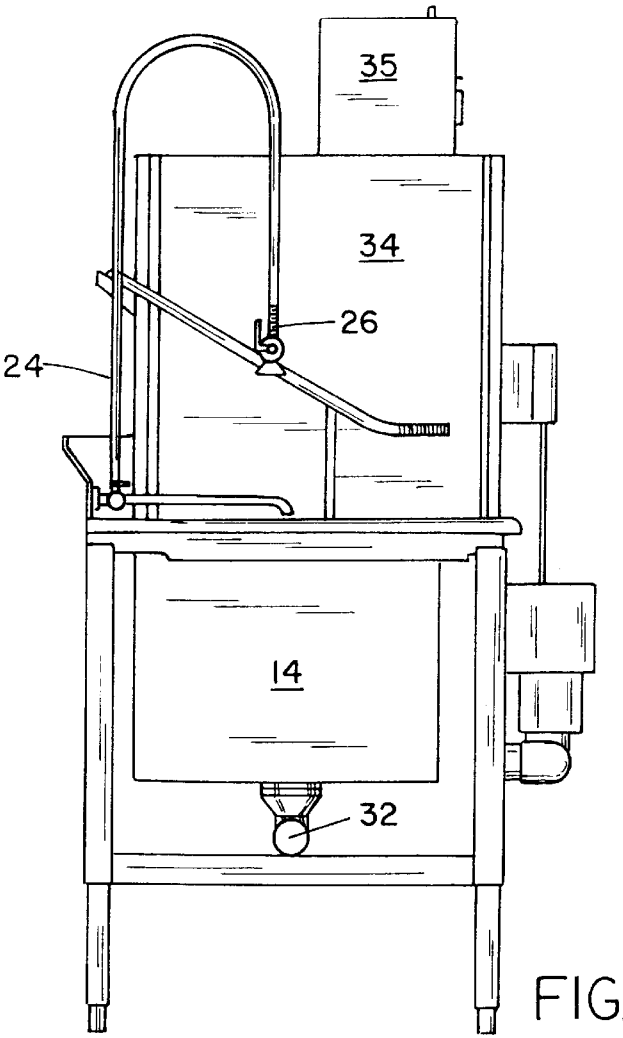
FIG. 7 is a left side view thereof.
Figure 6:
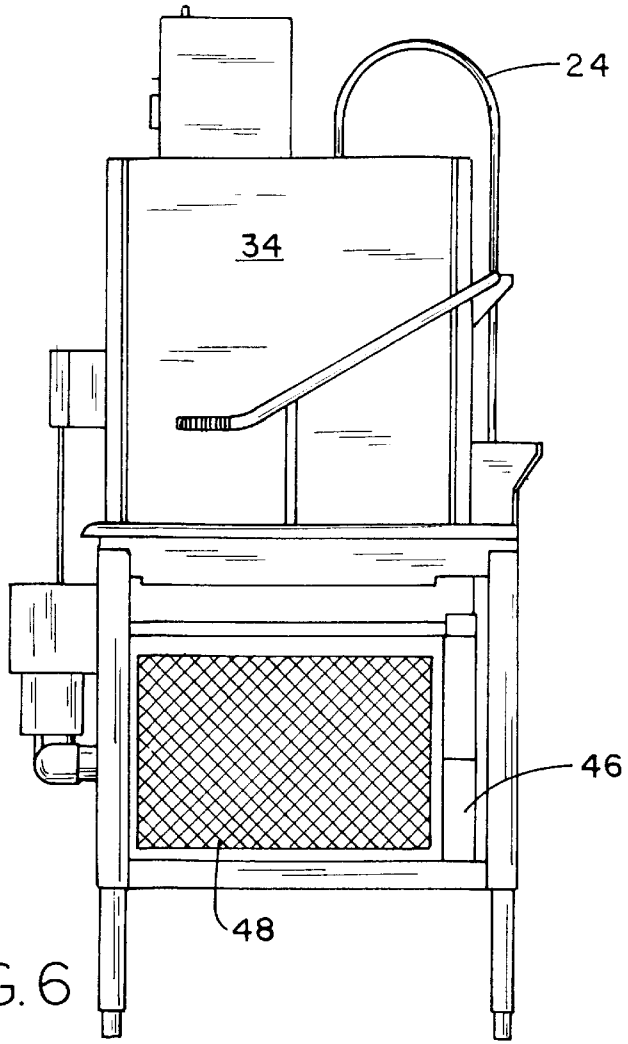
FIG. 6 is a right side view thereof.

Adjacent to the third sink member 18 is an automatic dishwasher or kitchenware apparatus 34 available from CMA Dishmachines of Garden Grove, Calif. This particular apparatus can wash a variety of kitchenware and is somewhat larger than the standard type dishwasher so as to be able to accommodate large food trays. It has a control 35 at the top to be able to provide the two usual wash cycles of a commercial dishwasher i.e. a wash cycle and rinse/sanitizer cycle by means of three pumps 37. The wash process of the machine is to wash and rinse. The pumps provide chemical for the two operations. Beneath the dishwasher apparatus 34 is a compartment 36 that includes a slide out storage drawer 38 for chemical agents used in the indicated two-cycle operation which chemical agents are drawn from bottles such as indicated at 40 which are placed in the drawer 38. The compartment 36 also includes an accumulator drawer 42 into which material washed from the objects in the dishwasher apparatus 34 is retained. Compartment 36 is also seen in FIG. 5 as well as a compartment 46 positioned beneath drying table 44 adjacent to the dishwasher apparatus 34. Dishwashing racks 48 are stored in the compartment 46.

Figure 1:
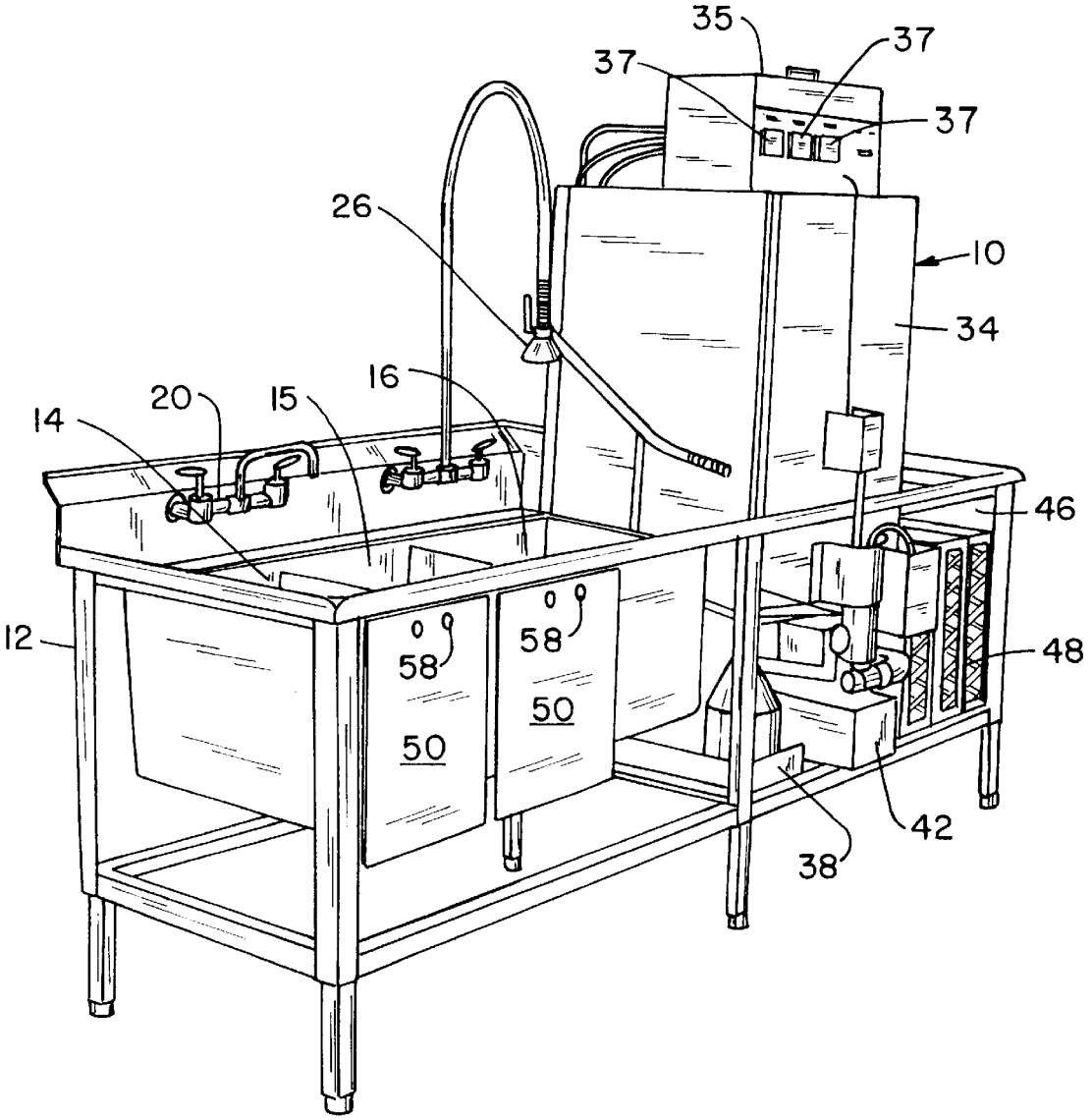
FIG. 1 is a perspective view of the compact kitchenware washing station of this invention.
Figure 2:
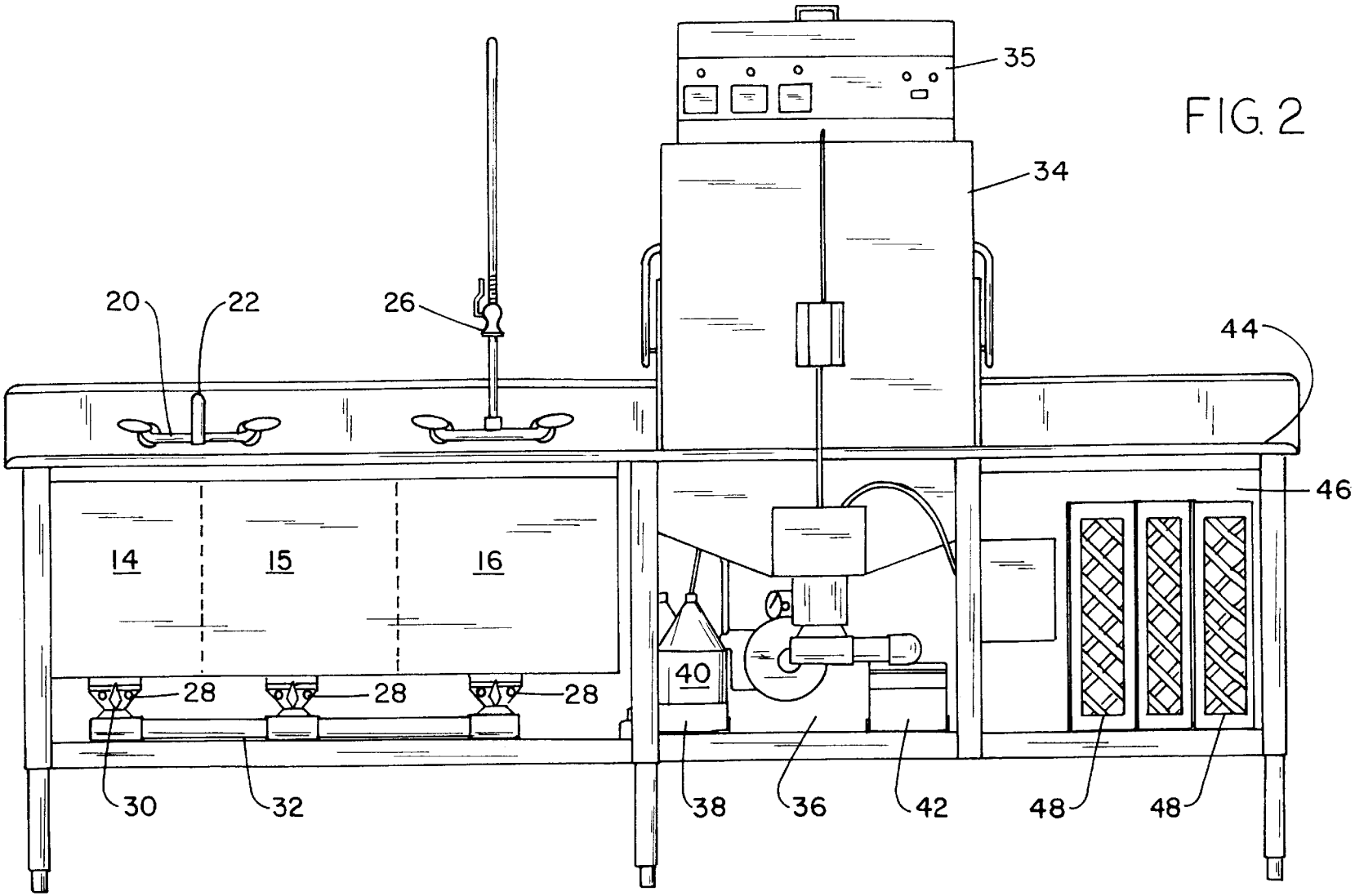
FIG. 2 is a front elevational view thereof.
Figure 4:
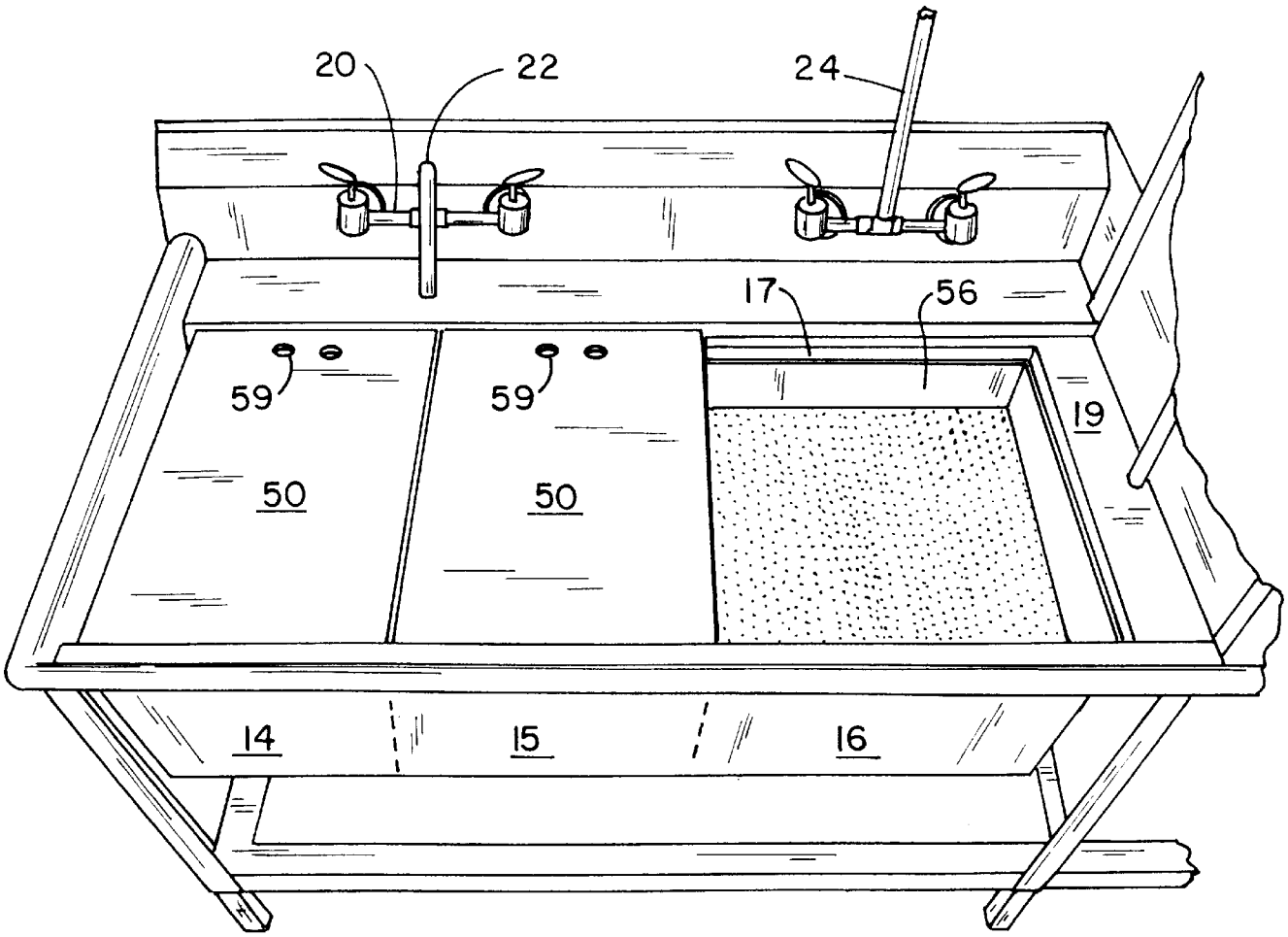
FIG. 4 is an enlarged top partial view illustrating the sink compartments; two of which are covered by cover members.

Referring specifically to FIG. 4, it is seen that there are the covers 50 which are placed over the sinks 14 & 15. When not in use the covers are hung by peg members 58 connected to the front of sinks 14 and 15 and extending through the finger holes 59. This is shown in FIGS. 1 and 4. As seen in FIG. 3 there are cleats 52 which extend across the comers of sink member 16. These support the scrap basket 56 when placed in sink member 16.

The advantages of the present kitchenware washing station 10 will be appreciated by a description of its operation. When it is desired to use the station in conjunction with the dishwashing apparatus 34, the covers 50 would be placed over the first and second sink members 14 and 15 as shown in FIG. 4. They would be supported along the rail portions such as shown at 17. Dishwashing racks 48 would be placed with dirty kitchenware onto and supported by the covers 50. At this station, any large pieces of food or material such as paperware would be removed and placed in a suitable container. Subsequently, the racks would be placed on the rails 17 over the scrap basket 56 and rinsed with the spray valve nozzle 26. After rinsing, the racks would be placed in the dishwasher and the usual sequence of detergent cycle, rinse additive cycle, and sanitizer cycle are effected. Subsequent to the automatic washing, the dishwashing racks with the clean kitchenware would now be placed on the drying table for air-drying. It should be noted in FIG. 4 that the railing such as 17 extends onto the support surface 19 for a smooth transition of the dishwashing racks into the washer 34 where the usual railings will support the dishwashing racks.

In the event a manual dishwashing operation is to be utilized, the covers 50 would be removed from the sink members 14 and 15 and placed on the front thereof as shown in FIG. 1. The sink members 14, 15, and 16 would be filled with detergent wash water, rinse water and sanitizing water in the sink members 14, 15, and 16, respectively. These sink members are filled with water by closing the drain valves with the knobs 30. In this instance racks 48 for the cleaned dishes would be placed on drying table 44 or a separate cart (not shown).

It will thus be seen that there's now provided a versatile kitchenware washing station which can afford both an automatic and a hand operation with a unitary and very compact design. In this instance, the entire length of the station is only 102 inches. Yet the sink members can support the automatic dishwashing operation in that they can be covered as previously explained. On the other hand, if an automatic operation is not required the three sink members afford the usual detergent, rinse additive, and sanitizer procedures. Further, in view of the compact design, the washing station is readily connected to utilities in an efficient manner.

While a kitchenware washing station has been described with various features, it is obvious that modifications thereof can be made and still utilize several of its features. For example, while drain valves 28 have been provided for the three sink members, it is obvious that these could be eliminated and the usual resilient plugs placed in the drains. Further while a particular dishwashing apparatus 34 has been described for use herein, it is obvious that any type of commercial apparatus could be substituted although the one described herein is preferred. While cover members 50 have been shown for storage support on the front of the sink members 14 and 15, by support through the finger holes 59 it is obvious they could be supported in various positions or placed on a support underneath the sink members.

We claim:

1. A compact kitchenware washing station capable of providing a variety of functions comprising:

first, second, and third sink members adjacently positioned and aligned with each other;

a cover member constructed and arranged to be placed over the first and second sink members;

at least one faucet member operatively associated with the first and second sink members;

a spray valve member operatively associated with the third sink member;

an automatic kitchenware washing apparatus positioned adjacent to the third sink member; and a table member positioned adjacent to the automatic kitchenware washing member and opposite the third sink member.

2. The compact kitchenware washing station as defined in claim 1 further including at least one storage support member for the cover member operatively associated with the first and second sink members.

3. The compact kitchenware washing station as defined in claim 1 further including a scrap basket member positioned in the third sink member.

4. The compact kitchenware washing station as defined in claim 1 further including a storage compartment positioned below the table member.

5. The compact kitchenware washing apparatus as defined in claim 1 further including a storage compartment positioned below the kitchenware washing apparatus.

6. The compact kitchenware washing apparatus as defined in claim 1 wherein the first, second, and third sink members, the automatic kitchenware washing apparatus and the table member are all supported on a one-piece frame.

7. A five stage compact kitchenware washing station capable of providing a variety of functions comprising:

first, second, and third sink members adjacently positioned and aligned with each other;

an automatic kitchenware washing apparatus positioned adjacent to the third sink member; and a table member positioned adjacent to the automatic kitchenware washing member and opposite the third sink member.

8. The five stage compact kitchenware washing station as defined in claim 7 wherein the first, second, and third sink members, the automatic kitchenware washing apparatus and the table member are support on a one-piece frame.

* * * * *